US012789325B2

(12) United States Patent
Kim et al.

(10) Patent No.: US 12,789,325 B2
(45) Date of Patent: Nov. 10, 2026

(54) DIAMOND TOOL AND METHOD OF MANUFACTURING THE SAME

(71) Applicant: SHINHAN DIAMOND INDUSTRIAL CO., LTD., Incheon (KR)

(72) Inventors: Shin Kyung Kim, Incheon (KR); Sung Gyu Kim, Incheon (KR); Eung Kwan Kwon, Incheon (KR); Jun Hyuk Hwang, Incheon (KR)

(73) Assignee: SHINHAN DIAMOND INDUSTRIAL CO., LTD., Incheon (KR)

( * ) Notice: Subject to any disclaimer, the term of this patent is extended or adjusted under 35 U.S.C. 154(b) by 365 days.

(21) Appl. No.: 18/426,459

(22) Filed: Jan. 30, 2024

(65) Prior Publication Data

US 2024/0342861 A1 Oct. 17, 2024

(30) Foreign Application Priority Data

Apr. 11, 2023 (KR) ..... 10-2023-0047285

(51) Int. Cl.
*B24D 5/06* (2006.01)

(52) U.S. Cl.
CPC ..... *B24D 5/06* (2013.01)

(58) Field of Classification Search
CPC .. C22C 1/05; B23P 15/28; B24D 5/06; B24D 5/12; B24D 5/123; B24B 7/06; B28D 1/041; B28D 1/121
USPC ..... 451/542, 547, 540; 125/15, 20
See application file for complete search history.

(56) References Cited

U.S. PATENT DOCUMENTS 2,427,085 A * 9/1947 Hugh ..... B28D 1/041 408/239 R
2,662,428 A * 12/1953 Mueller ..... B23B 51/0426 408/56
3,495,359 A * 2/1970 Phaal ..... E21B 10/48 175/379
4,274,769 A * 6/1981 Multakh ..... E21B 10/48 D15/139
4,354,561 A * 10/1982 Logan, Jr. ..... E21B 4/10 175/321
5,069,584 A * 12/1991 Obermeier ..... B24D 99/00 125/20
5,676,501 A * 10/1997 Peetz ..... B28D 1/041 408/206
2009/0326539 A1* 12/2009 Neumeyer ..... A61B 17/1637 606/80

(Continued)

FOREIGN PATENT DOCUMENTS

CN 113151722 A * 7/2021 ..... C22C 1/05
KR 20100070584 * 6/2010 ..... B23P 15/28
KR 20100070584 A * 6/2010 ..... B23P 15/28

*Primary Examiner* — Joel D Crandall
(74) *Attorney, Agent, or Firm* — Merchant & Gould P.C.

(57) ABSTRACT

A diamond tool is combined with a processing apparatus to process a workpiece. The diamond tool includes a shank, a segment, and an abrasion preventing part. The shank has a throughhole through which grinding powder generated during processing the workpiece by the processing apparatus is discharged outside. The segment is bonded to an end portion of the shank. The segment contacts and processes the workpiece. The abrasion preventing part is disposed on an adjacent portion among an outer surface of the shank adjacent to the throughhole to prevent abrasion of the outer surface during the processing of the workpiece.

11 Claims, 4 Drawing Sheets

(56) References Cited

U.S. PATENT DOCUMENTS

| | | | | |
|---|---|---|---|---|
| 2016/0354846 | A1* | 12/2016 | Heffernan | B26F 1/16 |
| 2021/0086272 | A1* | 3/2021 | Heath | B23B 51/0467 |
| 2021/0146455 | A1* | 5/2021 | Piller | G06Q 10/20 |

* cited by examiner

DIAMOND TOOL AND METHOD OF MANUFACTURING THE SAME

CROSS-REFERENCE TO RELATED APPLICATION

This application claims priority to Korean Patent Application No. 10-2023-0047285, filed on Apr. 11, 2023 and all the benefits accruing therefrom under 35 U.S.C. § 119, the contents of which are incorporated by reference in their entirety.

TECHNICAL FIELD

Example embodiments relate generally to a diamond tool and a method of manufacturing the same. More particularly, the example embodiments relate to a diamond tool capable of processing such as cutting or punching a workpiece and a method of manufacturing diamond tools for forming the diamond tool.

PRIOR ART

A diamond tool includes a shank (e.g., a body) and a plurality of segments arranged on an end portion of the shank.

Diamond particles are distributed on a surface of the segment. Thus, a worker may perform cutting, grinding, or punching a workpiece using the diamond tool.

The segment is composed of a bond including metal powder and a cutting material including industrial diamond distributed therein to perform direct cutting.

Diamond tools are classified into a diamond tool of a saw blade type and a diamond tool of a core bit type based on shapes of a shank and a segment.

The diamond tool of the saw blade type includes a metal shank of a disk shape and a plurality of segments (e.g., tips) bonded to a peripheral portion of the shank. The diamond tool of the saw blade type may be used to cut a workpiece.

The diamond tool of the core bit type includes a plurality of segments (e.g., tips) fixed to a metal shank of a cylindrical shape. The diamond tool of the core bit type may be used to perform punching to form a throughhole through a workpiece.

Here, diamond particles are distributed between metal powder (or bond metal) in the segment, and the diamond particles distributed on each segment perform cutting/grinding.

In general, powder metallurgy is used to manufacture the cutting/grinding segment. In particular, a mixture of metal powder of a powder type and diamond crystals is formed, and the mixture is molded to a segment shape. The molded mixture is heated at a high temperature through a sintering or hot pressing to form a cutting/grinding segment having a dense texture.

Then, the cutting/grinding segment is bonded to a shank through a bonding process such as a laser welding process, a brazing process using silver soldering, a diffusion bonding process using sintering, or the like.

The diamond tool is finally manufactured through a dressing process to smoothly perform an initial grinding of the product manufactured through the bonding process. In the dressing process, a surface of the segment is grinded using a wheel or the like to expose the diamond to the outside.

However, the method of manufacturing the tool requires complex processes such as the sintering process, which are required to manufacture the cutting/grinding segment. Also, the method of manufacturing the tool requires bonding processes such as welding, fusion, electrodeposition, or the like to fix the cutting/grinding segment to a tool body. Thus, a lot of processes, apparatuses, and labor are required to manufacture the cutting/grinding tool.

Meanwhile, a thickness of a shank included in the diamond tool is decreased, and the diamond tool is advantageous in the cutting process. However, durability of the diamond tool having the decreased thickness deteriorates. Thus, a diamond tool including a shank having a relatively thin thickness and excellent durability is required.

Furthermore, when grinding power, which is generated during the process of the diamond tool against the workpiece, is not smoothly discharged, abrasion of the shank may be accelerated.

SUMMARY

Some example embodiments provide a diamond tool including a shank capable of smoothly discharging grinding powder and having excellent durability.

Also, some example embodiments provide a method of manufacturing a diamond tool having a shank of excellent durability through a relatively simple process.

According to some example embodiments, a diamond tool is combined with a processing apparatus to process a workpiece. The diamond tool includes a shank, a segment, and an abrasion preventing part. The shank has a throughhole through which grinding powder generated during processing the workpiece by the processing apparatus is discharged outside. The segment is bonded to an end portion of the shank. The segment contacts and processes the workpiece. The abrasion preventing part is disposed on an adjacent portion among an outer surface of the shank adjacent to the throughhole to prevent abrasion of the outer surface during the processing of the workpiece.

In an embodiment, the shank may have a cylindrical shape, in which a plurality of throughholes are spaced apart from each other along a perimeter of the shank. The segment may be bonded to an end portion of the shank having the cylindrical shape. The abrasion preventing part may be formed between adjacent ones of the throughholes.

In an embodiment, the shank may have a disk shape. The shank may include a plurality of slots separated apart from each other in a circumferential direction of the shank and respectively connected to the throughholes. The segment may be bonded to a peripheral portion of the shank having the disk shape. The abrasion preventing part may include a first laser fusion part formed in the circumferential direction.

Here, in an embodiment, the abrasion preventing part may further include a second laser fusion part formed on a central portion of the shank, and a plurality of third laser fusion parts arranged between the first and second laser fusion parts.

Also, in an embodiment, the abrasion preventing part may have a height substantially the same as or smaller than the segment with respect to an outer surface of the shank.

In an embodiment, the abrasion preventing part may have a hardness in a range of about 50 HRB to about 120 HRB.

According to some example embodiments, a method of manufacturing a diamond tool is provided. A shank having a throughhole through which grinding power generated during processing a workpiece is discharged outside is formed. A segment contacting and processing the workpiece is formed. The segment is bonded to the shank. An abrasion preventing part is formed on a surface among an outer surface of the shank adjacent to the throughhole to prevent abrasion of the outer surface during the processing of the workpiece.

In an embodiment, the forming of the abrasion preventing part may include laser printing performed by irradiating a laser beam on the outer surface of the shank and spraying cutting particles and metal powder having a smaller density than the cutting particles.

Here, in an embodiment, the laser printing may use a laser printing device including a laser generating part, a transmitting part transmitting the laser generating part, and a cutting particle supplying part.

Also, in an embodiment, the laser generating part may have a transmission speed in a range of about 500 mm/min to about 2,000 mm/min, a laser pitch in a range of 0.1 mm to about 2.0 mm, and a power in a range of about 200 W to about 2,000 W.

According to the embodiments of the inventive concept, the diamond tool may include an abrasion preventing part disposed between throughholes on an outer surface of the shank. Thus, the diamond tool may include the shank having throughholes through which grinding power is smoothly discharged and having excellent durability.

Further, the abrasion preventing part may be formed through a relatively simple laser printing process, and the diamond tool may include the shank having excellent durability.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Figure 1:
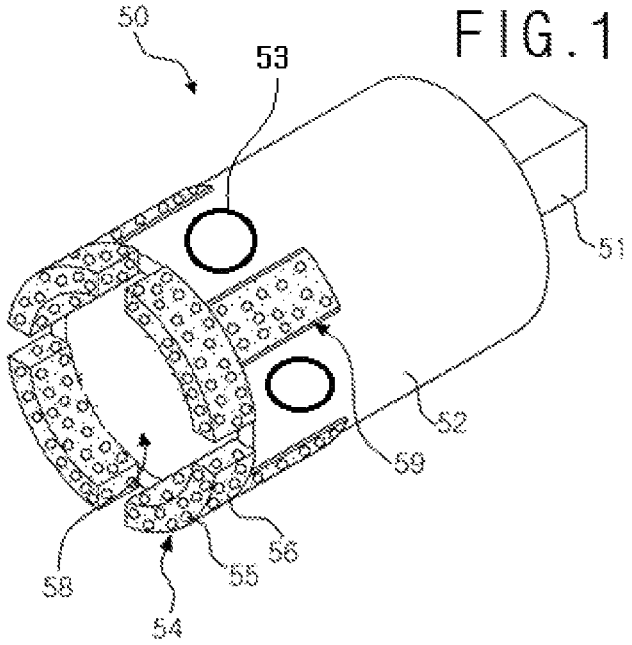
FIG. 1 is a perspective view illustrating a diamond tool according to one embodiment of the inventive concept.

Hereinafter, exemplary embodiments of the inventive concept will be described in detail with reference to the accompanying drawings. However, it will be understand that the inventive concept may be embodied in many alternative forms and should not be construed as limited to the example embodiments set forth herein. The exemplary embodiments described herein are not be provided to entirely complete the inventive concept but be provided so as a skilled person in the art of the inventive concept may embody the inventive concept.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). It will be understood that, although the terms first, second, third etc. may be used herein to describe various elements, these elements should not be limited by these terms. These terms are used to distinguish one element from another.

The terminology used herein is for the purpose of describing particular embodiments and is not intended to be limiting. Unless otherwise defined or implied herein, all terms (including technical and scientific terms) used herein have the same meaning as commonly understood by those skilled in the art to which this disclosure pertains. It will be further understood that terms, such as those defined in commonly used dictionaries, should be interpreted as having a meaning that is consistent with their meaning in the context of the relevant art and the disclosure, and should not be interpreted in an ideal or excessively formal sense unless clearly so defined herein.

Various embodiments are described herein with reference to sectional and/or exploded illustrations that are schematic illustrations of embodiments and/or intermediate structures. As such, variations from the shapes of the illustrations as a result, for example, of manufacturing techniques and/or tolerances, are to be expected. Thus, embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

Figure 2:
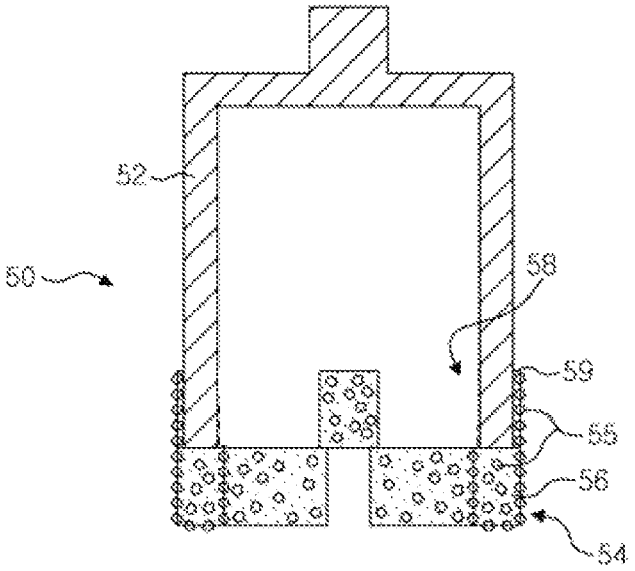
FIG. 2 is a cross-sectional view illustrating the diamond tool of FIG. 1.

FIG. 1 is a perspective view illustrating a diamond tool according to one embodiment of the inventive concept. FIG. 2 is a cross-sectional view illustrating the diamond tool of FIG. 1.

Referring to FIGS. 1 and 2, the diamond tool 50 according to the embodiment of the inventive concept may be combined with a processing apparatus and be used to process a workpiece. The processing apparatus may be used for surface grinding or hole processing based on a shape of the diamond tool 50.

The diamond tool 50 may include a combining part 51 to be combined with a processing apparatus such as a core drill or a hole cutter.

The diamond tool 50 may include a shank 52, a segment 54, and an abrasion preventing part 59. The shank 52 may have a combining part 51 on an end portion of the shank 52 to be combined with the processing apparatus.

Another end portion of the shank 52 may be formed in a cylindrical shape. A central space 58 may be formed in the shank 52. Here, the shank 52 may have various sizes based on a shape of the workpiece to be processed or a shape of punching. A throughhole 53 may be formed on the another end portion of the shank 52. The throughhole 53 may penetrate in a direction along a rotation axis of the shank 52 having the cylindrical shape.

The throughhole 53 may function as an outlet through which grinding powder generated by the processing apparatus during the processing of the workpiece is discharged.

Also, the throughhole 53 may be provided as a cooling space in which a heat generated during the operation of the processing apparatus. Furthermore, the throughhole 53 may provide flexibility to the shank 52 against the cutting load, which is applied during the operation of the processing apparatus.

The segment 54 may be provided around the another end portion of the shank 52 by a predetermined distance. A tip of the segment 54 may be in direct contact with the workpiece and may grind or cut the workpiece. Here, when the shank 52 rotates at a high speed by the processing apparatus, the segment 54 may grind a surface of the workpiece or punch the workpiece.

The abrasion preventing part 59 may be formed on an outer surface of the shank 52 adjacent to the throughhole 53. For example, the abrasion preventing part 59 may be arranged between adjacent throughholes 53.

The abrasion preventing part 59 may be formed using cutting particles including diamond and metal powder as raw materials. The abrasion preventing part 59 may be formed through a laser printing process using a laser having a wavelength passing through the diamond and melting the metal powder.

The abrasion preventing part 59 may prevent abrasion of the outer surface of the shank 52 during the processing of the workpiece.

The abrasion preventing part 59 may additionally process the outer surface of the hole during the processing of the workpiece. Thus, the diamond tool 50 may be smoothly received, and the processing dimension may be precisely maintained.

Meanwhile, since the diamond tool 50 of a core bit type includes the abrasion preventing part 59, the abrasion of the shank 52 may be prevented. Also, the abrasion preventing part 59 may prevent jamming of the diamond tool 50 during punching of the workpiece. The abrasion preventing part 59 may increase strength of the shank 52 and decrease a processing time.

Referring again to FIGS. 1 and 2, the shank 52 may have a cylindrical shape, in which a plurality of throughholes 53 may be spaced apart from each other along a perimeter of the shank 52. Here, the segment 54 may be bonded to the another end portion of the shank 52 having the cylindrical shape.

Meanwhile, the abrasion preventing part 59 may be formed between the throughholes 53. Thus, since the diamond tool 50 includes the abrasion preventing part 59 formed between the throughholes 53, the grinding powder generated by the segment 54 and the abrasion preventing part 59 during the processing of the processing apparatus may be discharged to the outside through the throughhole 53. Therefore, the damage to the surface of the shank 52 by grinding powder remaining thereon may be prevented.

According to the embodiment of the inventive concept, the abrasion preventing part 59 may have a hardness in a range of about 50 HRB to about 120 HRB. For example, when the metal power includes cobalt (Co), the abrasion preventing part 59 may have a hardness in a range of about 85 HRB to about 110 HRB. When the metal power includes iron (Fe), the abrasion preventing part 59 may have a hardness in a range of about 50 HRB to about 80 HRB. Meanwhile, when the metal powder includes tungsten (W), the abrasion preventing part 59 may have a hardness in a range of about 110 HRB to about 120 HRB.

Figure 3:
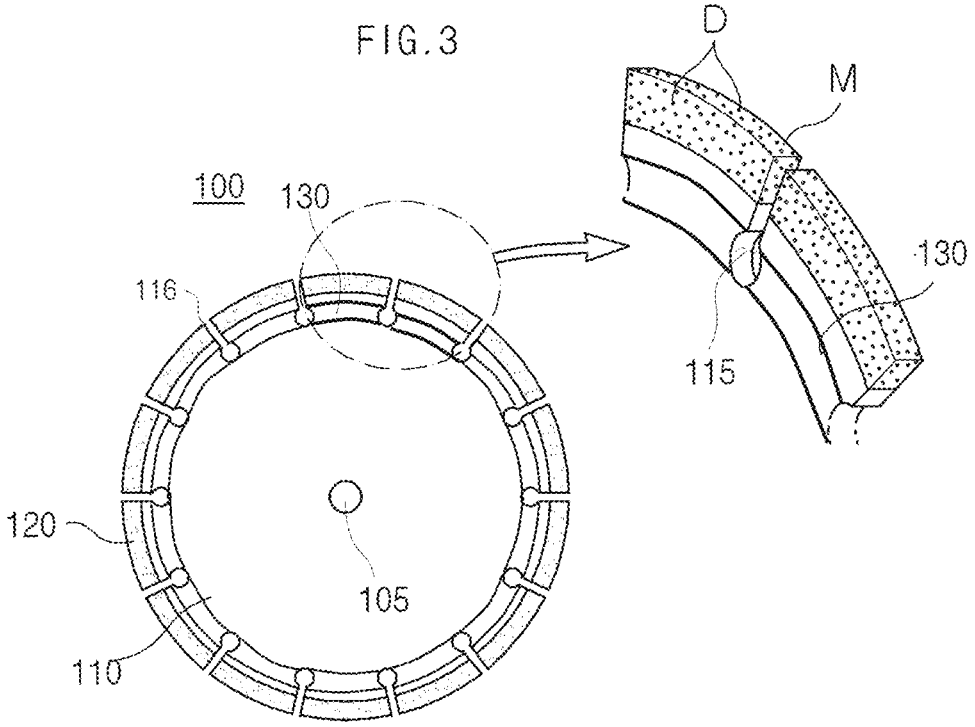
FIG. 3 is a plan view illustrating a diamond tool according to one embodiment of the inventive concept.
Figure 4:
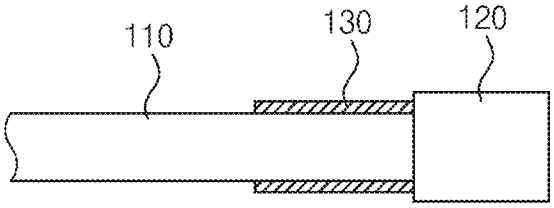
FIG. 4 is a cross-sectional view illustrating the diamond tool of FIG. 3.

FIG. 3 is a plan view illustrating a diamond tool according to one embodiment of the inventive concept. FIG. 4 is a cross-sectional view illustrating the diamond tool of FIG. 3.

Referring to FIGS. 3 and 4, a diamond tool 100 according to the embodiment of the inventive concept may include a shank 110, a segment 120, and an abrasion preventing part 130. The diamond tool 100 may be a saw blade type. The diamond tool 100 may be used to cut a portion of a workpiece.

The shank 110 may have a disk shape. A plurality of throughholes 115 may be arranged in a circumferential direction on the shank 110. The shank 100 may include a plurality of slots 116 spaced apart from each other in the circumferential direction of the shank 110 and respectively connected to the throughholes 115.

Meanwhile, the segment 120 may be bonded to a peripheral portion of the shank 110 having the disk shape.

The abrasion preventing part 130 may be formed on a side portion of the shank 110. The abrasion preventing part 130 may include a first lase fusion part formed in the circumferential direction of the shank 110.

Since the diamond tool 100 of the saw blade type includes the abrasion preventing part 130, the abrasion of the shank 110 may be prevented. In particular, the abrasion preventing part 130 may complement the strength of the shank 110 and decrease the cutting load of the side portion of the shank 110. Furthermore, the abrasion preventing part 130 may decrease a heat generated during the cutting and decrease a processing time of the workpiece.

The abrasion preventing part 130 may have a height substantially the same as or smaller than the segment 120 with respect to an outer surface of the shank 110. Thus, the segment 120 may process the workpiece, and then the abrasion preventing part 130 may contact the workpiece. Therefore, the abrasion of the shank 110 may be effectively prevented.

Figure 5:
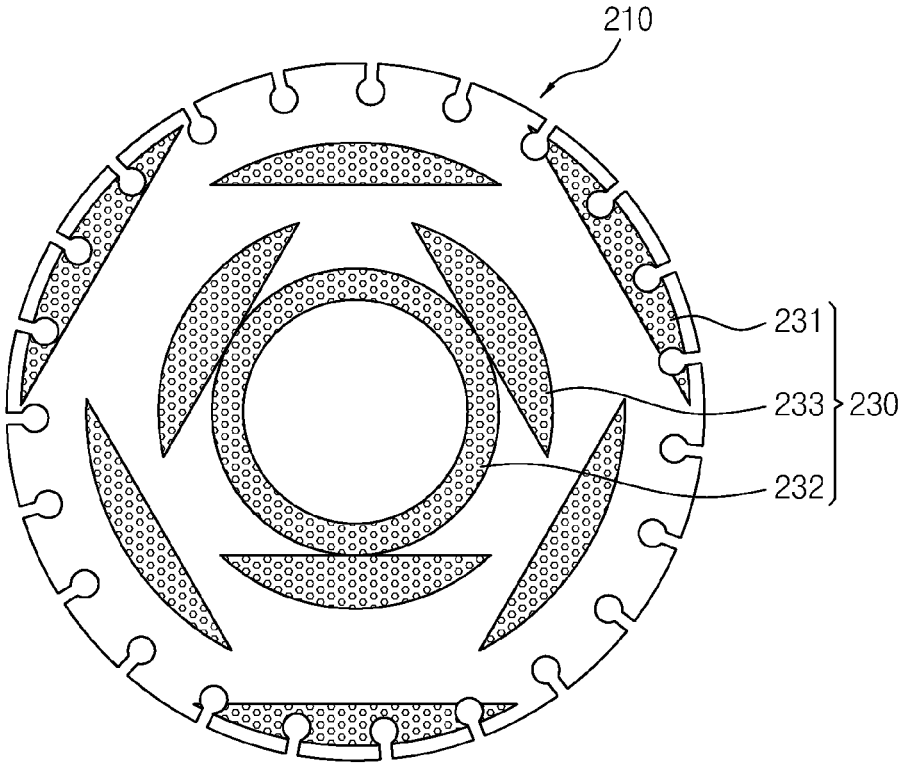
FIG. 5 is a front view illustrating the shank and the abrasion preventing part of FIG. 3 according to another embodiment.

FIG. 5 is a front view illustrating the shank and the abrasion preventing part of FIG. 3 according to another embodiment.

Referring to FIG. 5, an abrasion preventing part 230 may include a first laser fusion part 231, a second laser fusion part 232 formed on a central portion of a shank 210, and a third laser fusion part 233 arranged between the first and second laser fusion parts 231 and 232.

The second laser fusion part 232 may have a donut shape. Meanwhile, the third laser fusion part 233 may have a half-moon shape.

The second laser fusion part 232 and the third laser fusion part 233 may be formed on an outer surface of the shank 210, and may additionally preventing the abrasion of the shank 210.

Hereinafter, a method of manufacturing the above-described diamond tool according to the inventive concept and an operation thereof are described below.

Figure 6:
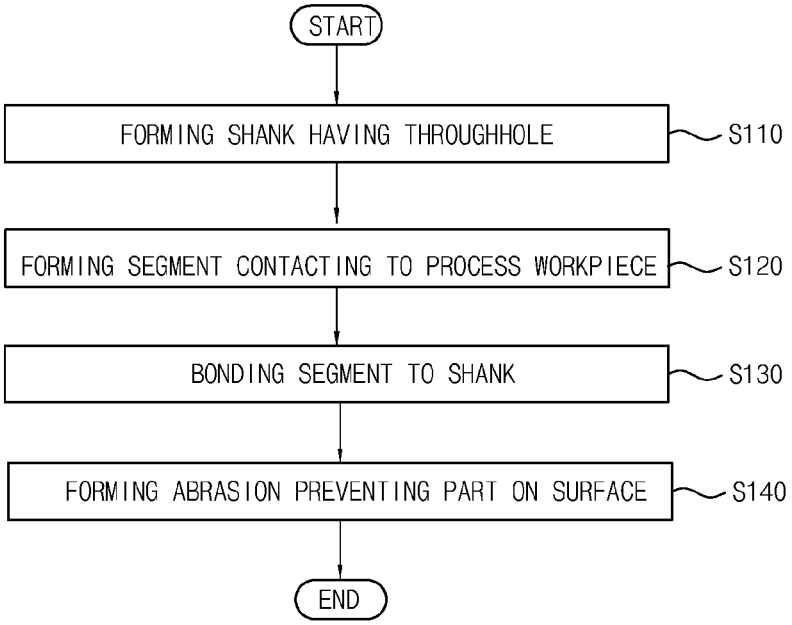
FIG. 6 is a perspective view illustrating a method of manufacturing a diamond tool according to one embodiment of the inventive concept.

FIG. 6 is a perspective view illustrating a method of manufacturing a diamond tool according to one embodiment of the inventive concept.

Figure 7:
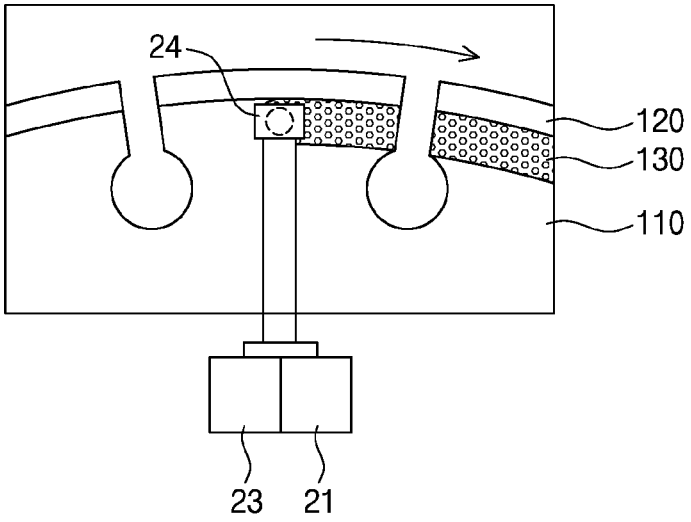
FIG. 7 is a schematic view illustrating a process of forming an abrasion preventing part included in the diamond tool of FIG. 6. according to one embodiment of the inventive concept.

FIG. 7 is a schematic view illustrating a process of forming an abrasion preventing part.

Referring to FIGS. 6 and 7, a shank 110 may be formed (step S110). Meanwhile, a segment 120 to be provided around the shank 110 may be formed (e.g., separately formed) (step S120). Here, the segment 120 may be formed by mixing a cutting material including abrasive grains made of diamond and a binder of metal powder, molding the mixture, and sintering the molded mixture through a sintering process.

Then, the segment 120 may be bonded to the shank 110 (step S130). The segment 120 may be bonded to an end portion of the shank 110 through various methods such as a laser welding, a brazing using silver soldering, a diffusion bonding by sintering, or the like. Thus, the segment 120 may be bonded to the shank 110 with an excellent bonding power, the separation of the segment 120 from the shank 110 may be prevented.

Then, an abrasion preventing part 130 may be formed on an outer surface of the shank 110 (step S140). The abrasion preventing part 130 may be formed by the following processes.

A laser printing process may be performed using a heating device 21 disposed adjacent to the shank 110. In the laser printing process, a laser beam is irradiated on a surface of the shank 110 and cutting particles and metal powder having a density greater than the cutting particles are sprayed on the surface of the shank 110. The metal powder may be fused to form a fusion layer on the surface of the shank 110 through the laser printing process. Here, the cutting particles may be included in the fusion layer. The fusion layer (e.g., a first fusion layer) in which the cutting particles and the metal powder are fused may be formed as the abrasion preventing part 130.

Meanwhile, the cutting particles and the metal powder provided from a cutting particle supplying part may be mixed in a mixing part 23, and the mixture of the cutting particles and the metal powder may be sprayed through a nozzle 24. Here, a spraying amount of the cutting particles and the metal powder provided to the mixing part 23 may be individually controlled.

The metal powder may include normal metal powder. For example, the metal powder may include one or more than two non-ferrous metals such as cobalt (Co), nickel (Ni), or the like.

In another embodiment, the metal powder may include pre-alloyed powder including one or more than two metals selected from the above-described metals. Also, the cutting material may include diamond particles. For example, the diamond particles may have the highest hardness.

Also, the heating device 21 may be a laser generating device emitting a laser having a wavelength passing through diamond (e.g., cutting particles). The laser generating device may be any one of a $CO_2$ laser device, an Nd-YAG laser device, a fiber laser device, a diode laser device, and a disk laser device.

The diamond particles are vulnerable to heat. Thus, the heating device 21 may be configured to control temperature of melted pool of the metal powder within a predetermined temperature.

Figure 8:
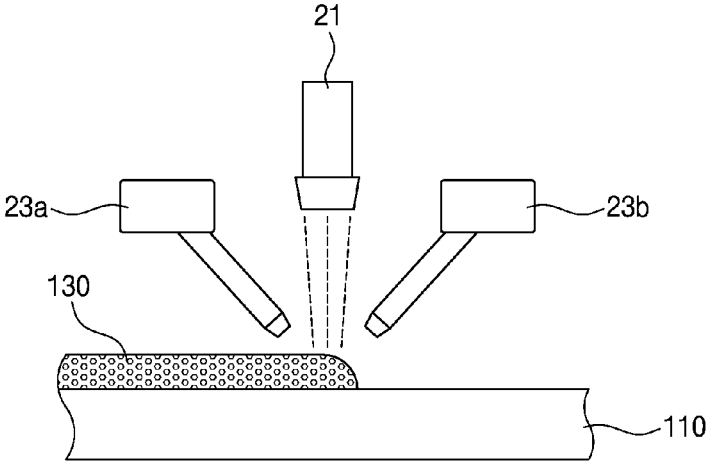
FIG. 8 is a schematic view illustrating a process of forming an abrasion preventing part included in the diamond tool of FIG. 6 according to another embodiment of the inventive concept.

FIG. 8 is a schematic view illustrating a process of forming an abrasion preventing part according to another embodiment of the inventive concept.

Referring to FIGS. 6 and 8, cutting particles provided from a cutting particle supplying part 23*a* and metal powder provided from a metal powder supplying part 23*b* may be individually sprayed toward a shank 110. Here, the heating device 21 may be a laser generating device 21 irradiating a laser having a wavelength passing through diamond which is cutting particles.

The laser generating device 21 used in the laser printing process may have a transmission speed in a range of about 500 mm/min to about 2,000 mm/min, a laser pitch in a range of about 0.1 mm to about 2.0 mm, and a power of about 200 W to about 2,000 W.

Referring to FIGS. 6 and 8, a non-contact thermometer (not shown) configured to sense temperature of the melted pool may be provided. When temperature of the melted pool sensed by the thermometer is greater than a predetermined temperature, a controlling part (not shown) may decrease output of the heating device 21. Also, when the temperature of the melted pool sensed by the thermometer is smaller than a predetermined temperature range, the controlling part (not shown) may increase the output of the heating device 21 to readily form the fusion layer.

In particular, a shank may be deformed during a heat treating process in a conventional fusion process. Meanwhile, a conventional electrodeposition process is complex and may have small grip strength on diamond particles.

However, compared with the conventional fusion process, the laser printing process of the embodiment of the inventive concept may have simple processes. Also, contents of program of the laser printing process may be readily modified, and process conditions may be readily changed. Thus, process may be readily automated.

Although preferred embodiments of the inventive concept have been disclosed for illustrative purposes, those skilled in the art will appreciate that various modifications, additions, and substitutions are possible, without departing from the scope and spirit of the disclosure as disclosed in the accompanying claims and their equivalents.

The invention claimed is:

1. A diamond tool combined with a processing apparatus to process a workpiece, the diamond tool comprising:

a shank having a plurality of throughholes spaced apart from each other along a perimeter of the shank, through which grinding powder generated during processing the workpiece by the processing apparatus is discharged outside;

a segment bonded to an end portion of the shank, the segment contacting and processing the workpiece; and an abrasion preventing part disposed on an outer surface of the shank between adjacent ones of the throughholes to prevent abrasion of the outer surface during the processing of the workpiece, wherein the abrasion preventing part increases strength of the shank.

2. The diamond tool of claim 1, wherein the shank has a cylindrical shape, and the plurality of throughholes are formed at an end portion of the shank, and the segment is bonded to the end portion of the shank having the cylindrical shape.

3. The diamond tool of claim 1, wherein the shank has a disk shape, the shank includes a plurality of slots separated apart from each other in a circumferential direction of the shank and respectively connected to the throughholes, the segment is bonded to a peripheral portion of the shank having the disk shape, and the abrasion preventing part includes a first laser fusion part formed in the circumferential direction.

4. The diamond tool of claim 3, wherein the abrasion preventing part further comprises:

a second laser fusion part formed on a central portion of the shank; and a plurality of third laser fusion parts arranged between the first and second laser fusion parts.

5. The diamond tool of claim 3, wherein the abrasion preventing part has a height substantially the same as or smaller than the segment with respect to an outer surface of the shank.

6. The diamond tool of claim 1, wherein the abrasion preventing part has a hardness in a range of about 50 HRB to about 120 HRB.

7. The diamond tool of claim 1, wherein the abrasion preventing part is formed using cutting particles including diamond and metal powder as raw materials through a laser printing process using a laser having a wavelength passing through the diamond and melting the metal powder.

8. A method of manufacturing a diamond tool, comprising:

forming a shank having a plurality of throughholes spaced apart from each other along a perimeter of the shank at an end portion of the shank, through which grinding powder generated during processing a workpiece is discharged outside;

forming a segment contacting and processing the workpiece;

bonding the segment to the shank; and forming an abrasion preventing part on an outer surface of the shank between adjacent ones of the throughholes at the end portion of the shank to prevent abrasion of the outer surface during the processing of the workpiece, wherein the abrasion preventing part increases strength of the shank.

9. The method of claim 8, wherein the forming of the abrasion preventing part comprises laser printing performed by irradiating a laser beam on the outer surface of the shank and spraying cutting particles and metal powder having a smaller density than the cutting particles.

10. The method of claim 9, wherein the laser printing uses a laser printing device comprises:

a laser generating part;

a transmitting part transmitting the laser generating part; and a cutting particle supplying part.

11. The method of claim 10, wherein the laser generating part has a transmission speed in a range of about 500 mm/min to about 2,000 mm/min, a laser pitch in a range of 0.1 mm to about 2.0 mm, and a power in a range of about 200 W to about 2,000 W.

* * * * *